US009088077B2

(12) United States Patent
Chang et al.

(10) Patent No.: US 9,088,077 B2
(45) Date of Patent: Jul. 21, 2015

(54) ANTENNA SYSTEM FOR WIRELESS COMMUNICATION DEVICE

(71) Applicant: Wistron NeWeb Corporation, Hsinchu (TW)

(72) Inventors: Ming-Feng Chang, Hsinchu (TW); Kai-Yang Cheng, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 298 days.

(21) Appl. No.: 13/760,072

(22) Filed: Feb. 6, 2013

(65) Prior Publication Data

US 2014/0168025 A1 Jun. 19, 2014

(30) Foreign Application Priority Data

Dec. 13, 2012 (TW) ..... 101147251 A

(51) Int. Cl.
*H01Q 21/28* (2006.01)
*H01Q 13/10* (2006.01)
*H01Q 1/52* (2006.01)

(52) U.S. Cl.
CPC ..... *H01Q 21/28* (2013.01); *H01Q 1/521* (2013.01); *H01Q 13/10* (2013.01); *H01Q 13/106* (2013.01)

(58) Field of Classification Search
CPC ..... H01Q 13/10; H01Q 13/106; H01Q 21/28
See application file for complete search history.

(56) References Cited

U.S. PATENT DOCUMENTS

| | | | | |
|---|---|---|---|---|
| 2010/0238079 | A1* | 9/2010 | Ayatollahi et al. | 343/729 |
| 2010/0321255 | A1* | 12/2010 | Kough et al. | 343/702 |
| 2013/0293425 | A1* | 11/2013 | Zhu et al. | 343/702 |
| 2013/0314293 | A1* | 11/2013 | Wong et al. | 343/848 |
| 2014/0015714 | A1* | 1/2014 | Hong et al. | 343/702 |

* cited by examiner

*Primary Examiner* — Robert Karacsony
(74) *Attorney, Agent, or Firm* — Winston Hsu; Scott Margo

(57) ABSTRACT

The present invention discloses an antenna system for a wireless communication device, which includes a first metal slice formed with a first slot structure, a second metal slice formed with a second slot structure, a first signal transmission line, and a second signal transmission line, wherein when the first metal slice and the second metal slice are not connected and have a distance between each other, a feeding direction of the first transmission corresponding to the first metal slice is substantially opposite to a feeding direction of the second transmission corresponding to the second metal slice; or when the first metal slice and the second metal slice are partially connected, a feeding direction of the first transmission corresponding to the first metal slice is substantially the same as or different to a feeding direction of the second transmission corresponding to the second metal slice.

12 Claims, 10 Drawing Sheets

ANTENNA SYSTEM FOR WIRELESS COMMUNICATION DEVICE

BACKGROUND OF THE INVENTION

1. Field of the Invention

The present invention relates to an antenna system for wireless communication device, and more particularly, to an antenna system capable of enhancing isolation between juxtaposed slot antennas.

2. Description of the Prior Art

Electronic products with wireless communication functionalities utilize antennas to emit and receive radio waves, to transmit or exchange radio signals, so as to access a wireless communication network. Therefore, to facilitate a user's access to the wireless communication network, an ideal antenna should maximize its bandwidth within a permitted range, while minimizing physical dimensions to accommodate the trend for smaller-sized electronic products. Additionally, with the advance of wireless communication technology, electronic products may be configured with an increasing number of antennas, to support multi-input multi-output (MIMO) technology or transmission requirement of multiple communication systems.

When an electronic product is configured with multiple antennas under a limited space, a basic requirement includes that these antennas are independent, do not affect each other, and have good isolation. Therefore, how to reduce mutual coupling between antennas becomes one of the industry goals. However, in the limited space, to enhance the isolation of the antennas and simultaneously maintain throughput of MIMO must increase design complexity. Therefore, it is a common goal in the industry to design antennas that suit both transmission demands, as well as dimension and functionality requirements.

SUMMARY OF THE INVENTION

It is therefore an objective of the present invention to provide an antenna system for wireless communication device which have good isolation.

The present invention discloses an antenna system for a wireless communication device, which comprises a first metal slice, substantially conforming to a rectangular shape, formed with a first slot structure substantially extending along a horizontal direction; a second metal slice, disposed on a side of the first metal slice along the horizontal direction, substantially conforming to a rectangular shape, formed with a second slot structure substantially extending along the horizontal direction, and separated from the first metal slice by a distance; a first signal transmission line, comprising a first metal wire, electrically connecting to a first feeding terminal of the first metal slice, for transmitting signals, wherein the first feeding terminal is substantially disposed on a side of the first slot structure along a vertical direction; a first isolation layer, covering the first metal wire; and a first metal weave, covering the first isolation layer and electrically connecting to a first signal grounding terminal to connect to a first signal ground, wherein the first signal grounding terminal is substantially disposed on another side of the first slot structure along the vertical direction; and a second signal transmission line, comprising a second metal wire, electrically connecting to a second feeding terminal of the second metal slice, for transmitting signals, wherein the second feeding terminal is substantially disposed on a side of the second slot structure along the vertical direction; a second isolation layer, covering the second metal wire; and a second metal weave, covering the second isolation layer and electrically connecting to a second signal grounding terminal to connect to a second signal ground, wherein the second signal grounding terminal is substantially disposed on another side of the first slot structure along the vertical direction; wherein a first direction from the first feeding terminal to the first signal grounding terminal is substantially opposite to a second direction from the second feeding terminal to the second signal grounding terminal.

The present invention discloses an antenna system for a wireless communication device, which comprises a first metal slice, substantially conforming to a rectangular shape, formed with a first slot structure substantially extending along a horizontal direction; a second metal slice, disposed on a side of the first metal slice along the horizontal direction, substantially conforming to a rectangular shape, formed with a second slot structure substantially extending along the horizontal direction, and partially connected to the first metal slice; a first signal transmission line, comprising a first metal wire, electrically connecting to a first feeding terminal of the first metal slice, for transmitting signals, wherein the first feeding terminal is substantially disposed on a side of the first slot structure along a vertical direction; a first isolation layer, covering the first metal wire; and a first metal weave, covering the first isolation layer and electrically connecting to a first signal grounding terminal to connect to a first signal ground, wherein the first signal grounding terminal is substantially disposed on another side of the first slot structure along the vertical direction; and a second signal transmission line, comprising a second metal wire, electrically connecting to a second feeding terminal of the second metal slice, for transmitting signals, wherein the second feeding terminal is substantially disposed on a side of the second slot structure along the vertical direction; a second isolation layer, covering the second metal wire; and a second metal weave, covering the second isolation layer and electrically connecting to a second signal grounding terminal to connect to a second signal ground, wherein the second signal grounding terminal is substantially disposed on another side of the first slot structure along the vertical direction.

The present invention discloses an antenna system for a wireless communication device, which comprises a first metal slice, substantially conforming to a rectangular shape, formed with a first slot structure substantially extending along a horizontal direction; a second metal slice, disposed on a side of the first metal slice along the horizontal direction, substantially conforming to a rectangular shape, formed with a second slot structure substantially extending along the horizontal direction; a first signal transmission line, comprising a first metal wire, electrically connecting to a first feeding terminal of the first metal slice, for transmitting signals, wherein the first feeding terminal is substantially disposed on a side of the first slot structure along a vertical direction; a first isolation layer, covering the first metal wire; and a first metal weave, covering the first isolation layer and electrically connecting to a first signal grounding terminal to connect to a first signal ground, wherein the first signal grounding terminal is substantially disposed on another side of the first slot structure along the vertical direction; and a second signal transmission line, comprising a second metal wire, electrically connecting to a second feeding terminal of the second metal slice, for transmitting signals, wherein the second feeding terminal is substantially disposed on a side of the second slot structure along the vertical direction; a second isolation layer, covering the second metal wire; and a second metal weave, covering the second isolation layer and electrically connecting to a second signal grounding terminal to connect to a second signal ground, wherein the second signal grounding terminal is substantially disposed on another side of the first slot structure along the vertical direction; wherein a first direction from the first feeding terminal to the first signal grounding terminal is substantially opposite to a second direction from the second feeding terminal to the second signal grounding terminal.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
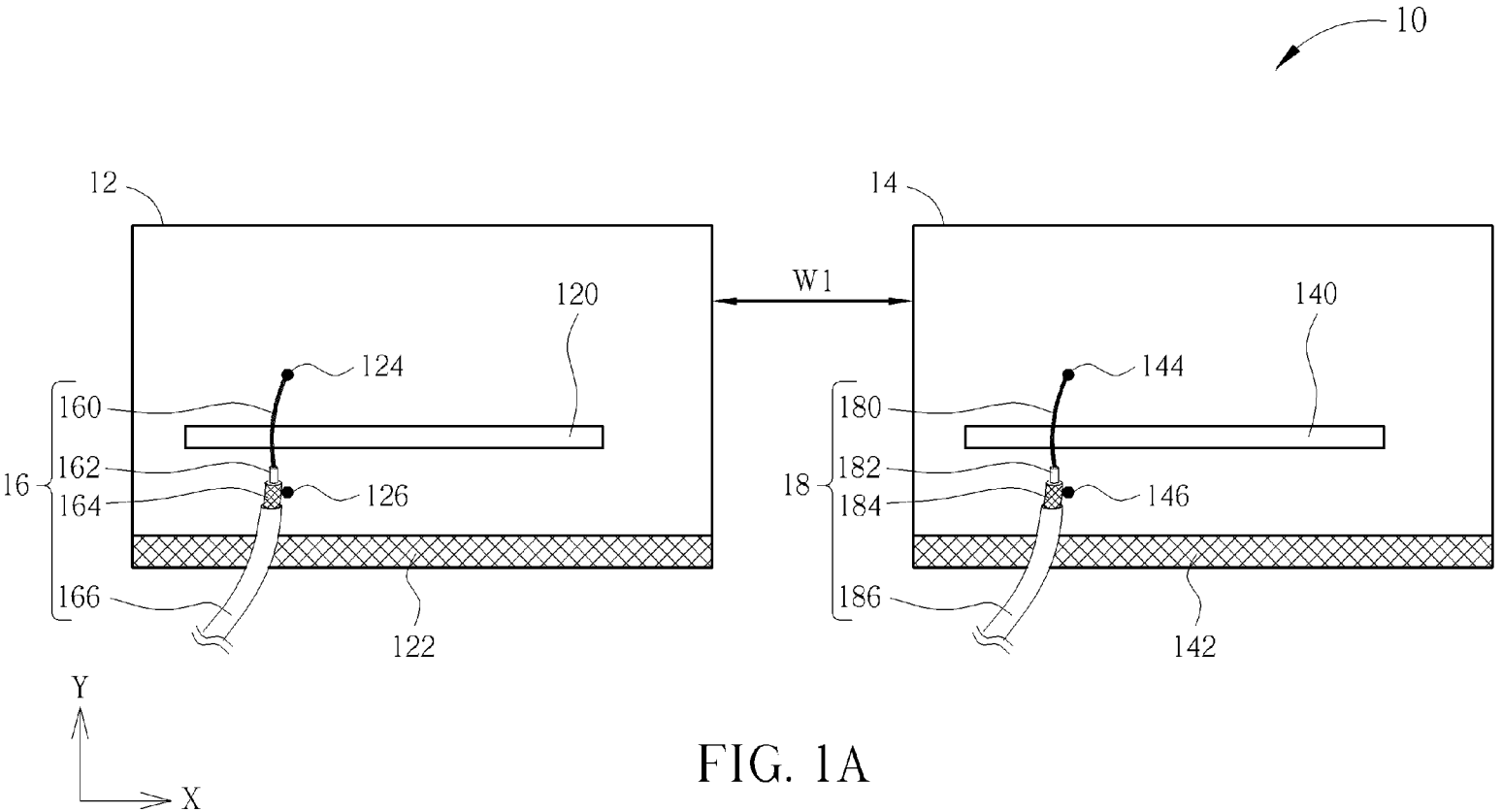
FIG. 1A is a schematic diagram of an antenna system.

Please refer to FIG. 1A. FIG. 1A is a schematic diagram of an antenna system 10. The antenna system 10 is utilized in wireless communication device, and supports multi-input multi-output (MIMO). The antenna system 10 is mainly composed of a first metal slice 12, a second metal slice 14, a first signal transmission line 16, and a second signal transmission line 18. The first metal slice 12 is substantially rectangular and formed with a first slot structure 120 substantially extending along a horizontal direction X by means of etching or punching; and a grounding element 122 is below the first slot structure 120. Similarly, the second metal slice 14 is substantially rectangular and formed with a second slot structure 140 substantially extending along the horizontal direction X by means of etching or punching; and a grounding element 142 is below the second slot structure 140. The first signal transmission line 16 is disposed cross upper and lower sides of the first slot structure 120, and includes a first metal wire 160, a first isolation layer 162, a first metal weave 164, and a first protection layer 166 respectively from inside to outside. The first metal wire 160 is electrically connected to the first metal slice 12 through a welding point 124, and the first metal weave 164 is electrically connected to the first metal slice 12 through a welding point 126, wherein the welding point 124 is a feeding terminal for transmitting signals, and the welding point 126 is a signal grounding terminal for connecting a signal ground. In the same way, the second signal transmission line 18 is disposed cross upper and lower sides of the second slot structure 140, and includes a second metal wire 180, a second isolation layer 182, a second metal weave 184 and a second protection layer 186 from inside to outside. The second metal wire 180 is electrically connected to the second metal slice 14 through a welding point 144, and the second metal weave 184 is electrically connected to the second metal slice 14 through a welding point 146, wherein the welding point 144 is a feeding terminal for transmitting signals, and the welding point 146 is a signal grounding terminal for connecting the signal ground.

Figure 1B:
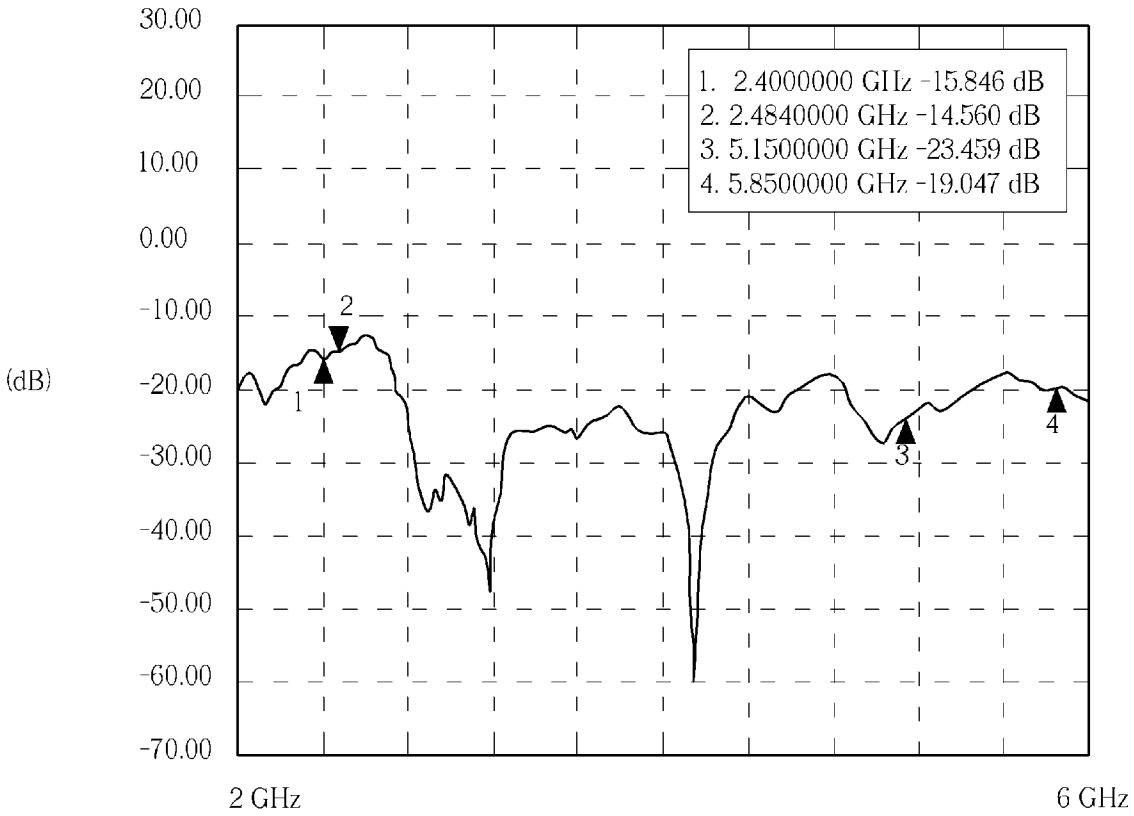
FIG. 1B is a schematic diagram of isolation of the antenna system shown in FIG. 1A.

In short, the antenna system 10 can be seen as a result of juxtaposing two identical slot antennas separated by a distance W1. Under such a situation, if the antenna system 10 is utilized for frequency bands of 2.4 GHz and 5 GHz, isolation of the antenna system 10 is shown in FIG. 1B. As can be seen in FIG. 1B, isolation of the antenna system 10 around 2.4 GHz is only −13 dB to −15 dB. However, in some applications, isolation in the range between −13 and −15 dB may cause signal coupling or interference between the two slot antennas, and may lead to problems such as transmitting or receiving failure.

Therefore, to enhance isolation of slot antennas, the present invention further realizes antenna systems by different feeding manners or by means of adding parasitic elements. However, slot structures, material and sizes of metal slices for realizing the slot antennas are not the key issues in the present invention, and those skilled in the art can make adjustments according to different applications. For example, applicant of the present invention has disclosed some slot structures in U.S. patent application Ser. No. 13/745,857, which provides different slot antennas and can be properly modified for the present invention.

Figure 2A:
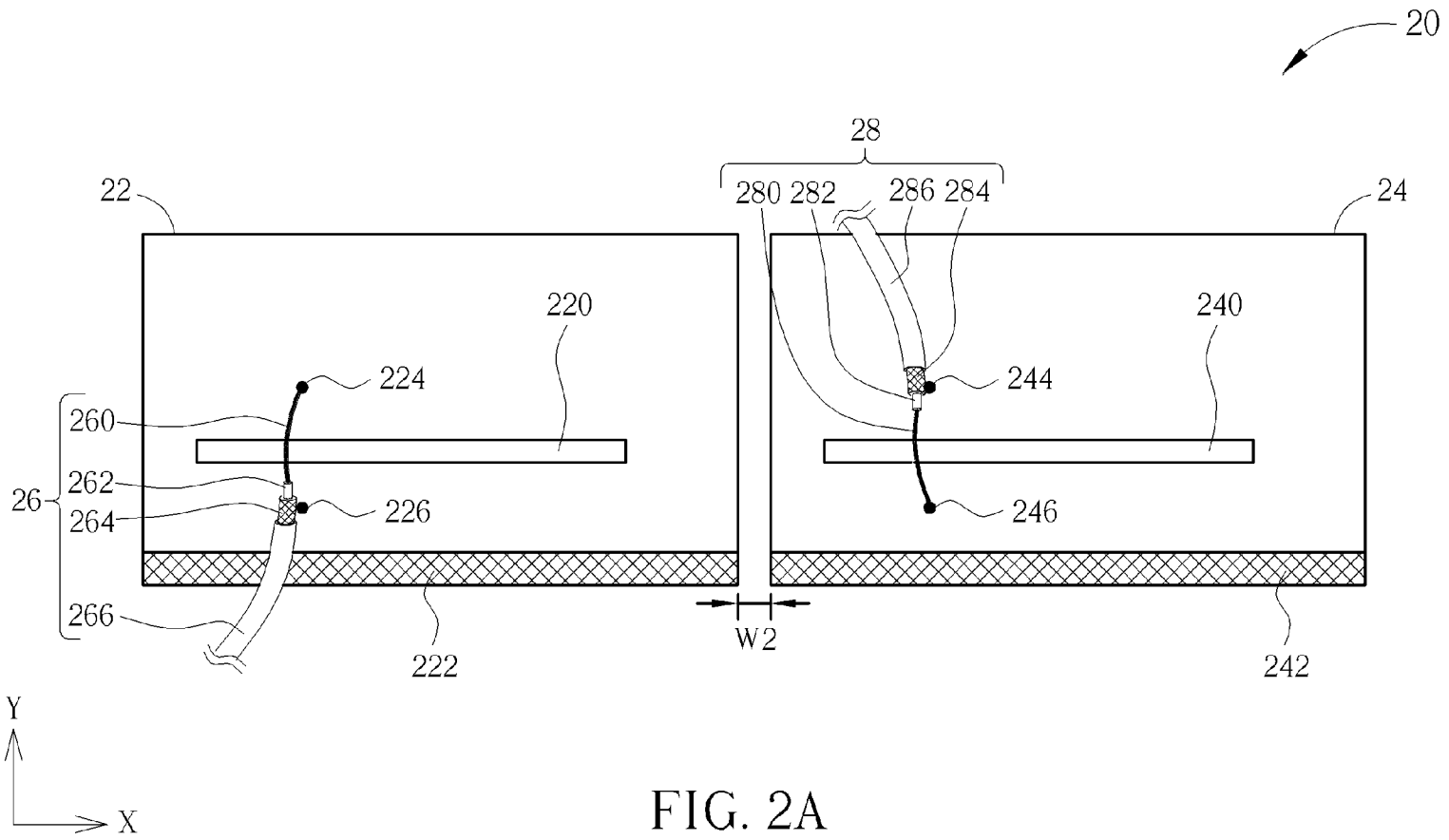
FIG. 2A is a schematic diagram of an antenna system according to an embodiment of the present invention.

Please refer to FIG. 2A. FIG. 2A is a schematic diagram of an antenna system 20 according to an embodiment of the present invention. Structures of the antenna system 20 and the antenna system 10 are similar. In the same way as the antenna system 10, the antenna system 20 is utilized in a wireless communication device, and supports multi-input multi-output. Comparing to the antenna system 10, the antenna system 20 has a different signal feeding direction, to enhance isolation. In detail, the antenna system 20 is mainly composed of a first metal slice 22, a second metal slice 24, a first signal transmission line 26 and a second signal transmission line 28. The first metal slice 22 substantially conforms to a rectangular shape and is formed with a first slot structure 220 substantially extending along the horizontal direction X by means of etching or punching. A grounding element 222 is below the first slot structure 220. Similarly, the second metal slice 24 substantially conforms to a rectangular shape and is formed with a second slot structure 240 substantially extending along the horizontal direction X by means of etching or punching. A grounding element 242 is below the second slot structure 240. The first signal transmission line 26 is disposed cross two sides along a vertical direction Y of the first slot structure 220. The first signal transmission line 26 includes a first metal wire 260, a first isolation layer 262, a first metal weave 264 and a first protection layer 266 from inside to outside. The first metal wire 260 is electrically connected to the first metal slice 22 through a welding point 224, and the first metal weave 264 is electrically connected to the first metal slice 22 through a welding point 226, wherein the welding point 224 is a feeding terminal for transmitting signals, and the welding point 226 is a signal grounding terminal for connecting a signal ground. In the same way, the second signal transmission line 28 is disposed cross the two sides along the vertical direction Y of the second slot structure 240. The second signal transmission line 28 includes a second metal wire 280, a second isolation layer 282, a second metal weave 284 and a second protection layer 286 from inside to outside. The second metal wire 280 is electrically connected to the second metal slice 24 through a welding point 244, and the second metal weave 284 is electrically connected to the second metal slice 24 through a welding point 246, wherein the welding point 244 is a feeding terminal for transmitting signals, and the welding point 246 is a signal grounding terminal for connecting the signal ground.

As can be seen by comparing FIG. 1A and FIG. 2A, a direction from the welding point 124 to the welding point 126 and a direction from the welding point 144 to the welding point 146 are the same in the antenna system 10, and both are from top to bottom (i.e. a direction from the feeding terminal to the signal grounding element on the first metal slice 12 is the same as a direction from the feeding terminal to the signal grounding element on the second metal slice 14). In comparison, a direction from the welding point 224 to the welding point 226 and a direction from the welding point 244 to the welding point 246 are substantially opposite in the antenna system 20. The direction from the welding point 224 to the welding point 226 is from top to bottom, and the direction from the welding point 244 to the welding point 246 is from bottom to top (i.e. a direction from the feeding terminal to the signal grounding element on the first metal slice 22 is opposite to a direction from the feeding terminal to the signal grounding element on the second metal slice 24). By different feeding directions of the first signal transmission line 26 and the second signal transmission line 28 corresponding to the first metal slice 22 and the second metal slice 24, the antenna system 20 can enhance isolation between slot antennas. Besides, a distance W2 between the first metal slice 22 and the second metal slice 24 is smaller than the distance W1 in FIG. 1A. Such a disposing manner further enhances isolation.

Figure 2B:
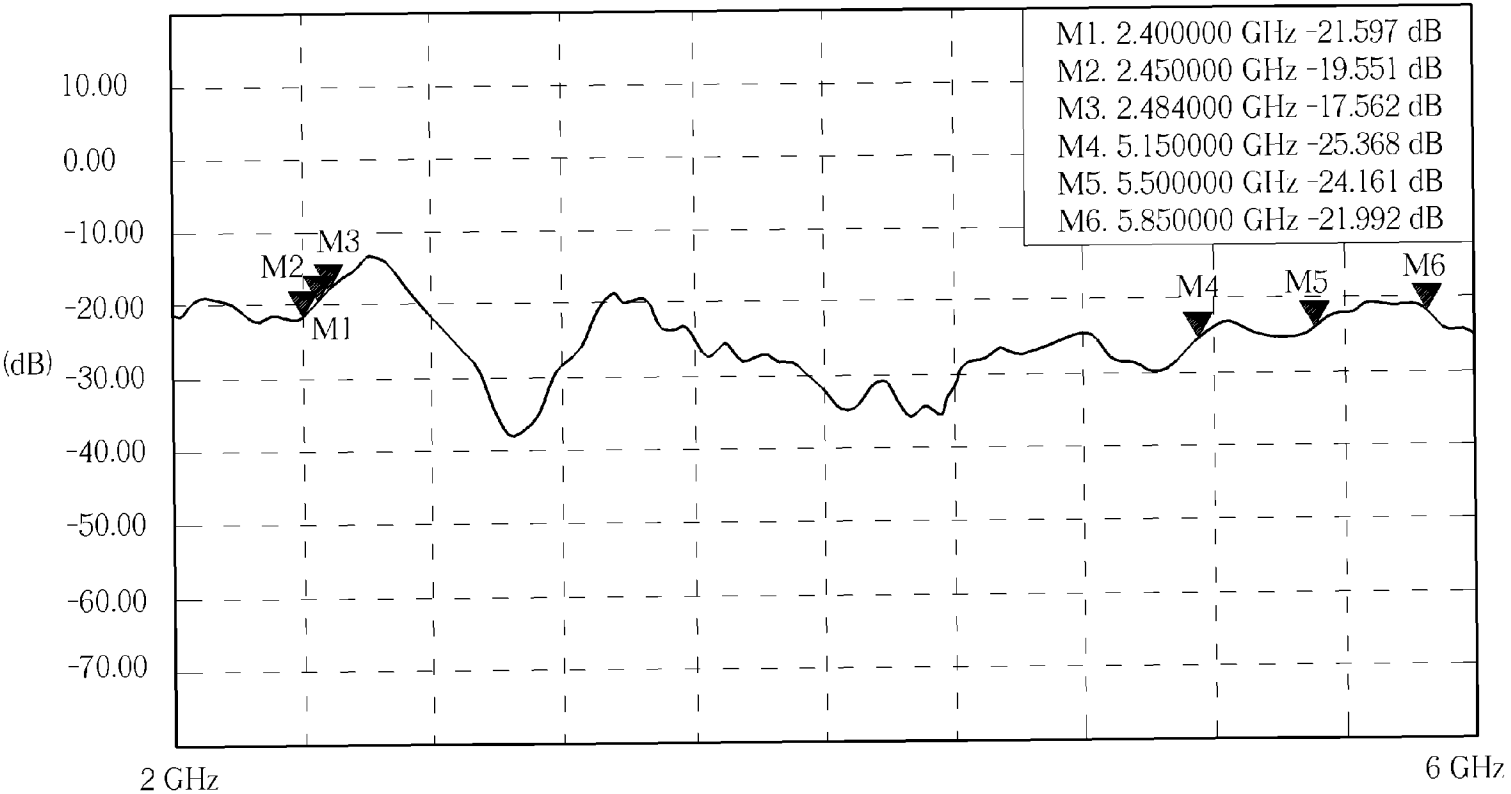
FIG. 2B is a schematic diagram of current directions of the antenna system shown in FIG. 2A.

Please further refer to FIG. 2B. FIG. 2B is a schematic diagram of isolation of the antenna system 20 utilized in frequency bands of 2.4 GHz and 5 GHz. As can be seen from FIG. 2B, isolation around 2.4 GHz can reach −17 dB to −20 dB in the antenna system 20. Comparing to the antenna system 10, isolation of the antenna system 20 is obviously improved and thus the antenna system 20 can effectively reduce signal coupling or interference between two slot antennas, so as to enhance the transmitting efficiency.

Figure 2C:
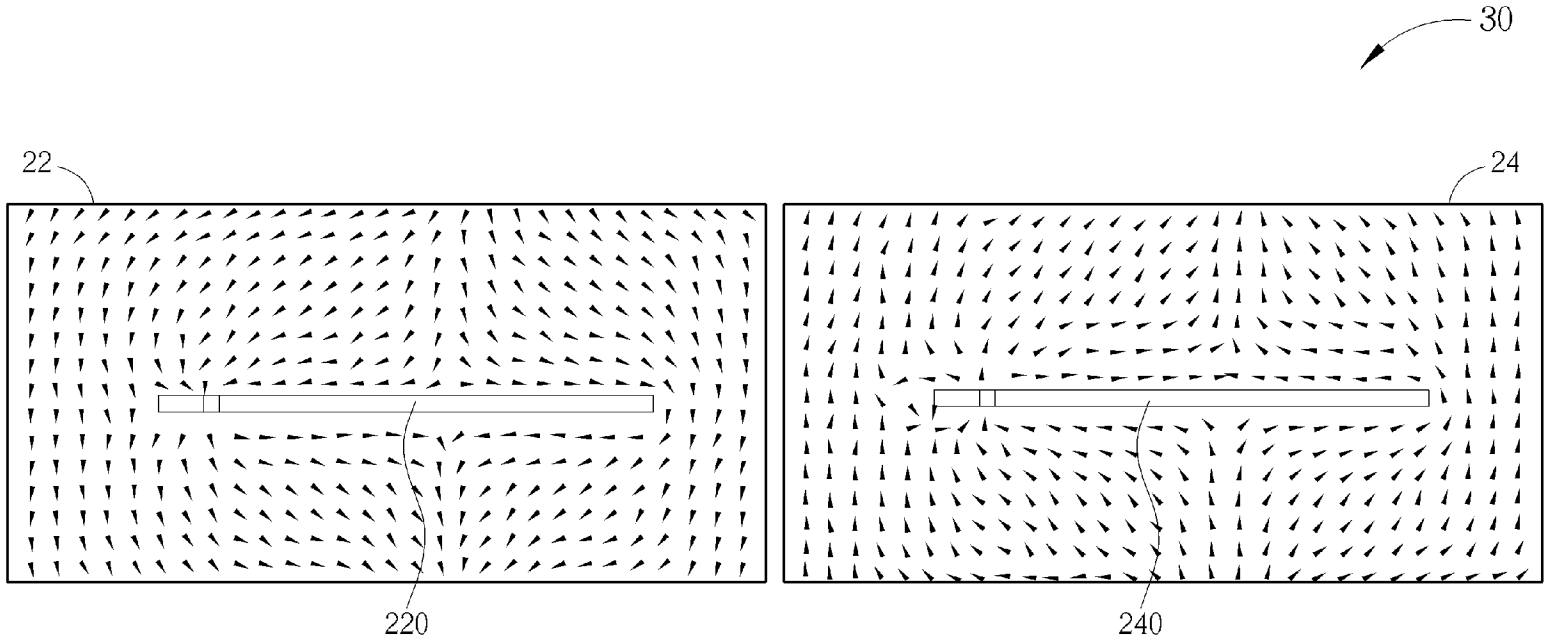
FIG. 2C is a schematic diagram of current directions of the antenna system.

The different feeding directions between the first signal transmission line 26 and the second signal transmission line 28 are mainly for generating opposite current directions on the first metal slice 22 and the second metal slice 24, to eliminate interference. Please refer to FIG. 2C. FIG. 2C is a schematic diagram of current directions of the antenna system 20. As can be seen in FIG. 2C, current directions of adjacent portion between the first metal slice 22 and the second metal slice 24 are opposite, and signal interference is accordingly cancelled.

In addition to using different feeding directions to enhance isolation, the present invention further enhances isolation by increasing parasitic elements.

Figure 3A:
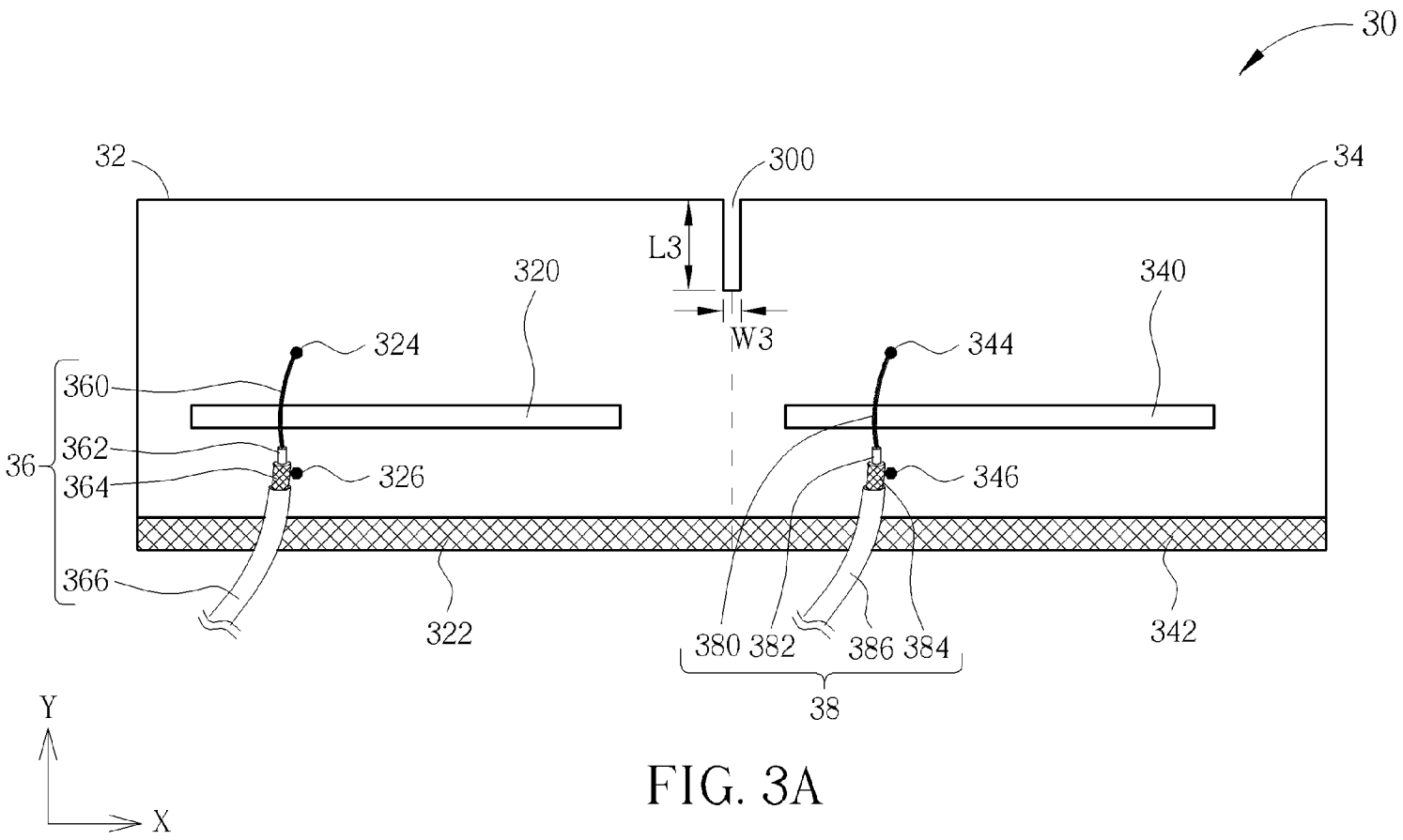
FIG. 3A is a schematic diagram of an antenna system according to an embodiment of the present invention.

Please refer to FIG. 3A, FIG. 3A is a schematic diagram of an antenna system 30 according to an embodiment of the present invention. Structures of the antenna system 30 and the antenna system 10 in FIG. 1A are similar. In the same way as the antenna system 10, the antenna system 30 is utilized for a wireless communication device, and supports multi-input multi-output. Comparing to the antenna system 10, the antenna system 30 further enhances isolation by at least a parasitic element. In detail, the antenna system 30 is mainly composed of a first metal slice 32, a second metal slice 34, a first signal transmission line 36 and a second signal transmission line 38. The first metal slice 32 conforms to a rectangular shape and is formed with a first slot structure 320 substantially extending along the horizontal direction X by means of etching or punching. A grounding element 322 is below the first slot structure 320. Similarly, the second metal slice 34 conforms to a rectangular shape and is formed with a second slot structure 340 substantially extending along the horizontal direction X by means of etching or punching. A grounding element 342 is the second slot structure 340. The first signal transmission line 36 is disposed cross two sides along a vertical direction Y of the first slot structure 320, and includes a first metal wire 360, a first isolation layer 362, a first metal weave 364 and a first protection layer 366 from inside to outside. The first metal wire 360 is electrically connected to the first metal slice 32 through a welding point 324, and the first metal weave 364 is electrically connected to the first metal slice 32 through a welding point 326, wherein the welding point 324 is a feeding terminal for transmitting signals, and the welding point 326 is a signal grounding terminal for connecting signal ground. In the same way, the second signal transmission line 38 is disposed cross upper and lower sides of the second slot structure 340, and includes a second metal wire 380, a second isolation layer 382, a second metal weave 384 and a second protection layer 386 from inside to outside. The second metal wire 380 is electrically connected to the second metal slice 34 through a welding point 344, and the second metal weave 384 is electrically connected to the second metal slice 34 through a welding point 346, wherein the welding point 344 is a feeding terminal for transmitting signals, and the welding point 346 is a signal grounding terminal for connecting signal ground.

Figure 3B:
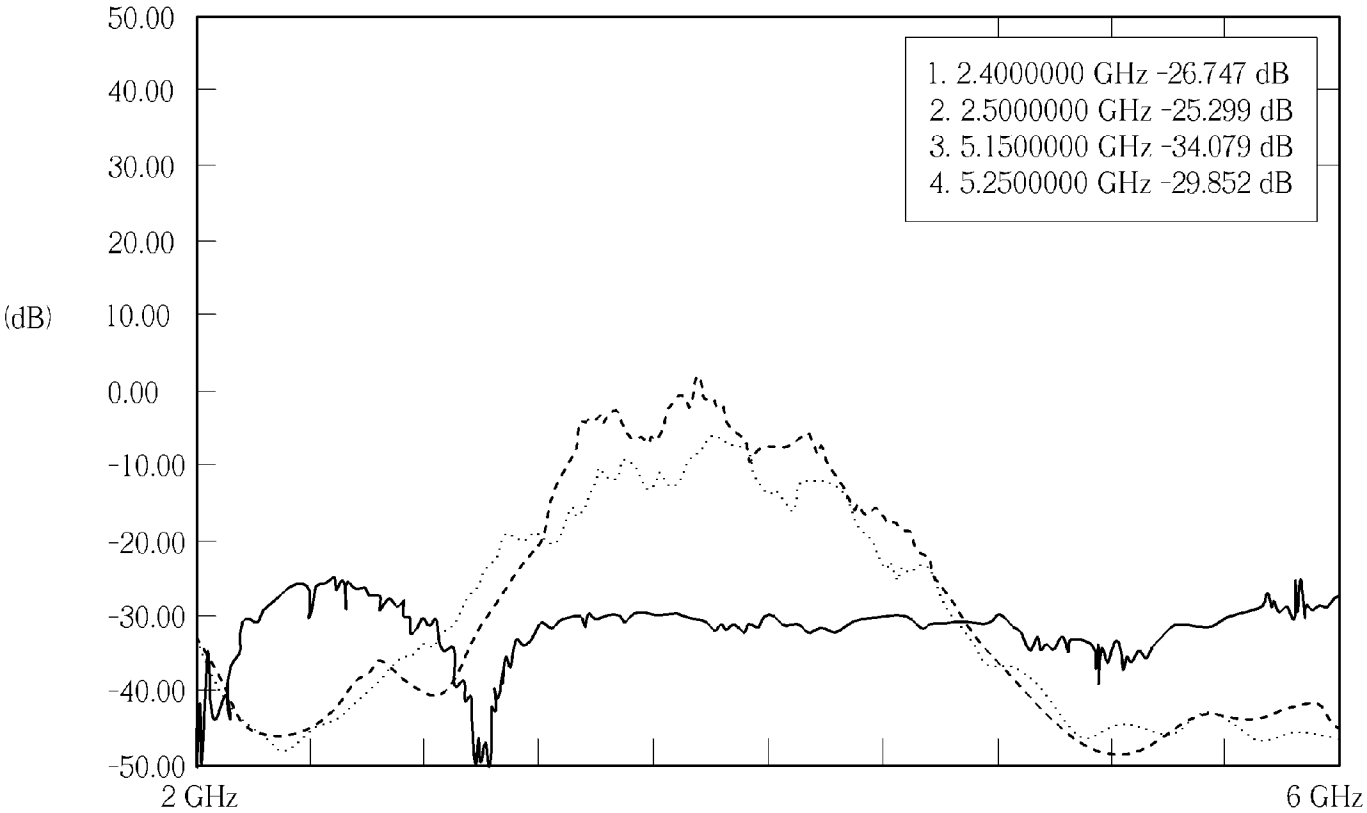
FIG. 3B is a schematic diagram of isolation of the antenna system shown in FIG. 3A.

Comparing FIG. 3A and FIG. 1A, the structure of the antenna system 30 is similar to that of the antenna system 10, and a main difference between the antenna systems 30 and 10 is that the first metal slice 32 and the second metal slice 34 of the antenna system 30 are partially connected. In other words, the grounding element 322 and the grounding element 342 are connected. In addition, an open slot structure 300 is formed on a separated portion between the first metal slice 32 and the second metal slice 34. A length L3 of the open slot structure 300 is substantially equal to a quarter of a wavelength of wireless signals corresponding to a wireless frequency band of the wireless communication device, and a width W3 (e.g., 0.1 mm-1 mm) is related to isolation of the two slot antennas. In such a situation, if the antenna system 30 is utilized for frequency bands of 2.4 GHz and 5 GHz, antenna characteristics of the antenna system 30 are shown in FIG. 3B, wherein a dashed line represents a curve of voltage standing wave ratio (VSWR) corresponding to the first slot structure 320, a dotted line represents a curve of VSWR corresponding to the second slot structure 340, and a solid line represents a curve of isolation corresponding to the first slot structure 320 and the second slot structure 340. As can be seen from FIG. 3B, the isolation of the antenna system 30 around 2.4 GHz reaches −25 dB, which is better than the antenna systems 10 and 20, and thus the antenna system 30 can effectively reduce signal coupling or interference between two slot antennas, to enhance performance of transmission.

The open slot structure 300 is a parasitic element, which switches current directions of the first metal slice 22 and the second metal slice 24 to reduce coupling effect, and thus enhances isolation. Please note that, the open slot structure 300 is a bar-type slot, which is an embodiment of the present invention. Structures able to achieve the parasitic element are suitable for the present invention. For example, the open slot structure 300 may further include at least one bend or turning, or include two or more branches to form L shape, U shape, etc. On the other hand, except the open slot structure 300, closed slot structures can also be adopted to enhance isolation.

Figure 4:
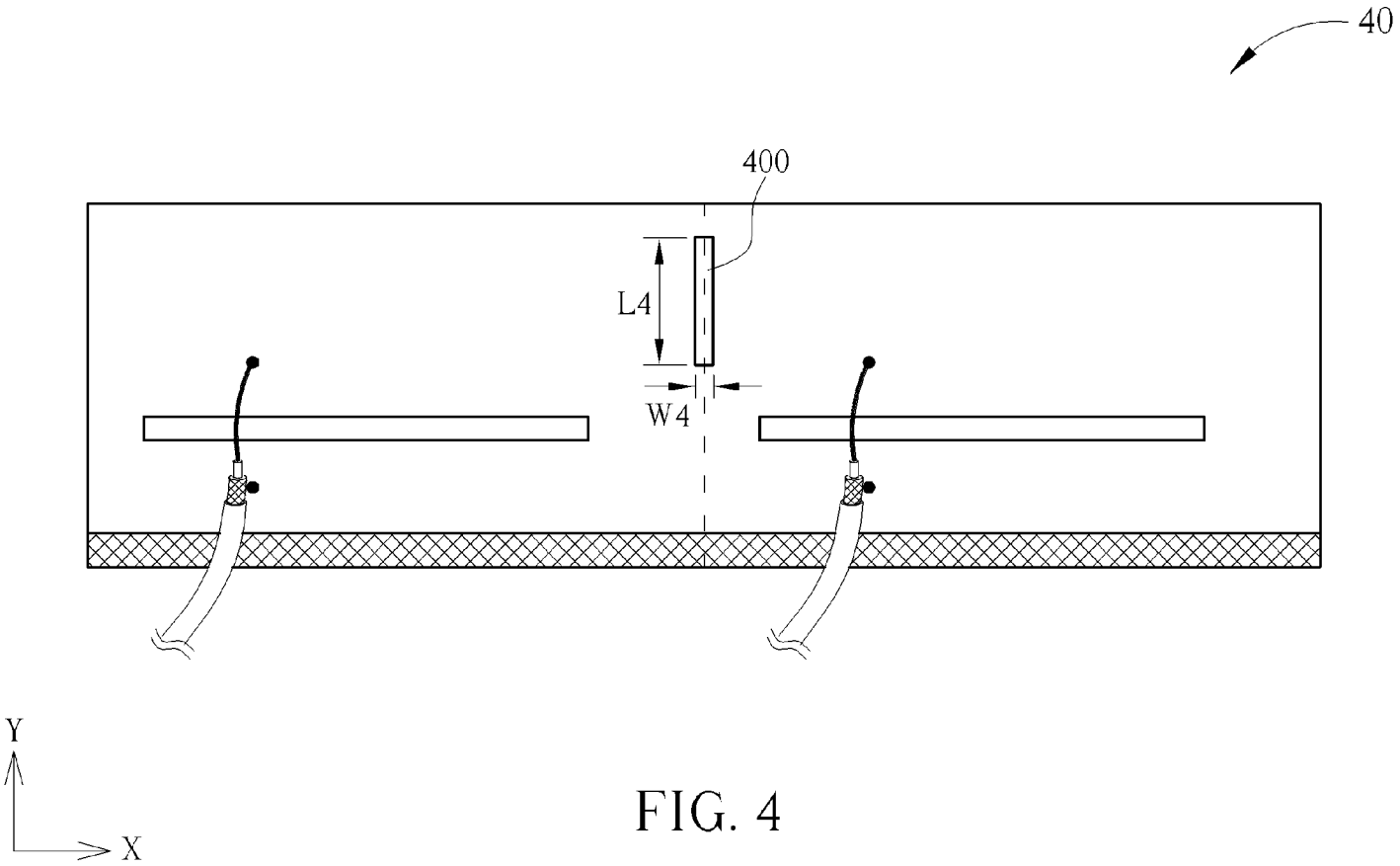
FIG. 4 is a schematic diagram of an antenna system according to an embodiment of the present invention.

For example, please refer to FIG. 4. FIG. 4 is a schematic diagram of an antenna system 40 according to an embodiment of the present invention. Structures of the antenna system 40 and the antenna system 30 in FIG. 3A are similar, and thus most of symbols are omitted for simplicity. The main difference between the antenna system 40 and the antenna system 30 is that a parasitic element of the antenna system 40 is a closed slot structure 400 with a length L4 substantially equal to half of a wavelength of wireless signals corresponding to a wireless frequency band of the wireless communication device, and a width W4 (e.g., 0.1 mm to 1 mm) is related to isolation of two slot antennas. The closed slot structure 400 also switches current directions to reduce signal coupling or interference between two slot antennas and thus enhances isolation. Certainly, the closed slot structure 400 may also include at least a bend or turning, etc., or two or more branches to form L shape, U-shape, I-shape, etc.

Figure 5:
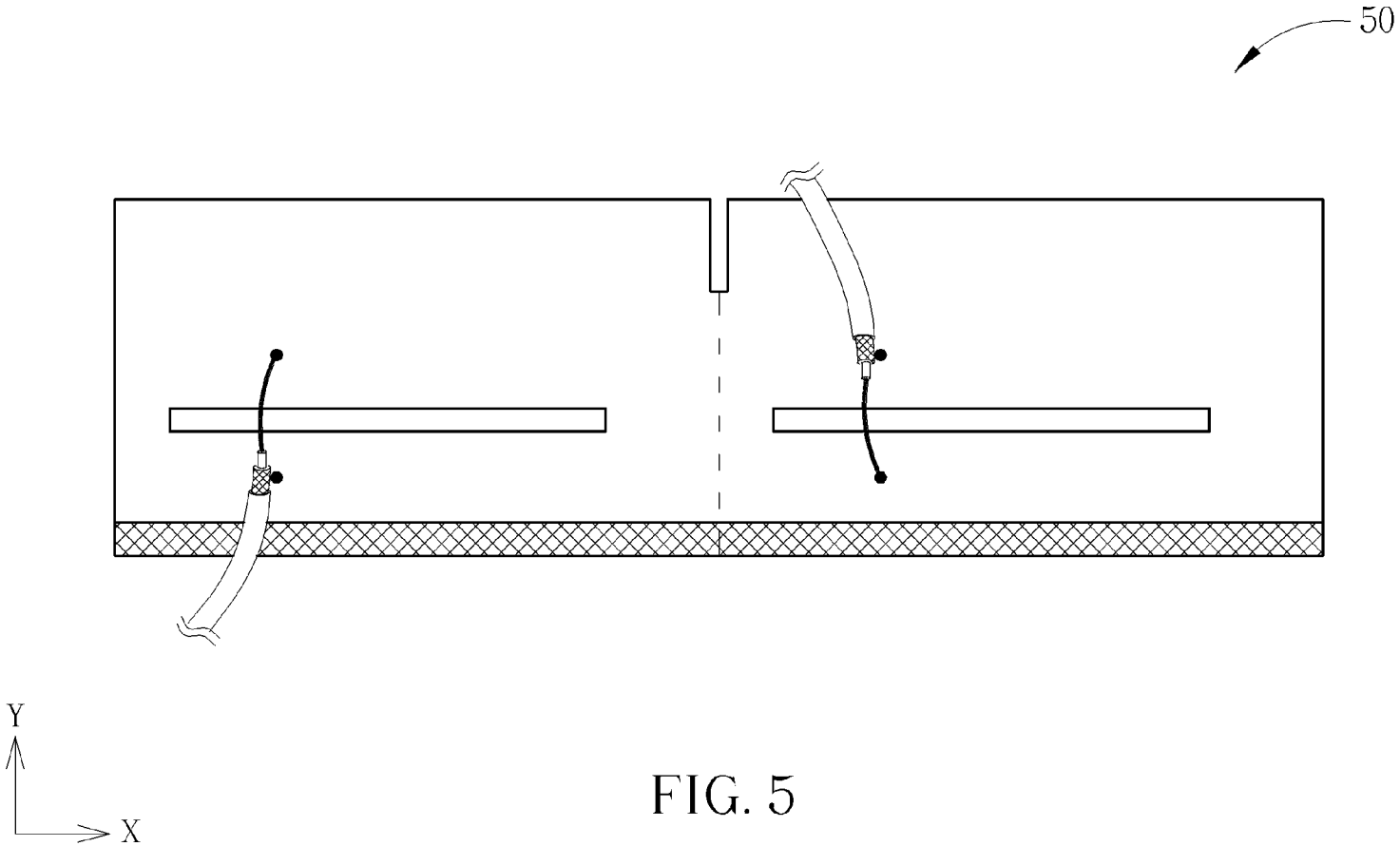
FIG. 5 is a schematic diagram of an antenna system according to an embodiment of the present invention.
Figure 6:
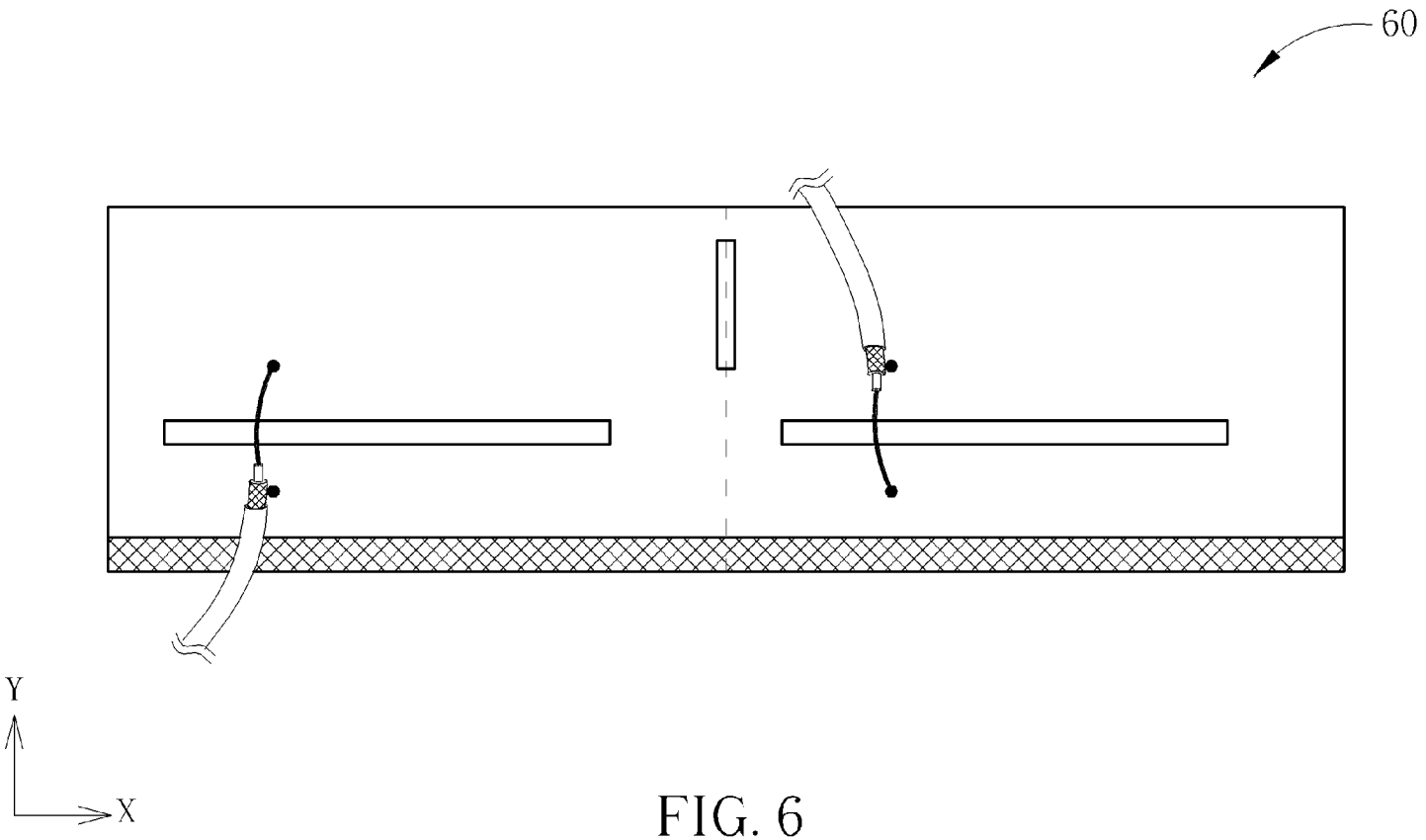
FIG. 6 is a schematic diagram of an antenna system according to an embodiment of the present invention.

In the embodiments of FIG. 3A and FIG. 4, the directions from the feeding terminals of the two slot antennas to the signal grounding elements are the same, which is not limited thereto. As shown in FIG. 2A, different feeding directions can also be adopted to enhance isolation. For example, FIG. 5 and FIG. 6 show antenna systems 50 and 60. The antenna systems 50 and 60 are respectively derived from the antenna systems 30 and 40 shown in FIG. 3A and FIG. 4, and thus most of symbols are omitted for simplicity. The main differences between the antenna systems 50, 60 and the antenna systems 30, 40 are that the feeding directions of the two slot antennas in the antenna systems 50, 60 are substantially opposite, as similar to the different feeding directions shown in FIG. 2A. Therefore, the antenna systems 50, 60 can effectively reduce signal coupling or interference between two slot antennas, to enhance the transmitting efficiency.

As can be seen, to enhance isolation of juxtaposed slot antennas, the present invention separates two slot antennas by a specific distance, and uses different feeding directions to generate opposite currents on adjacent portion of the two slot antennas, so as to reduce signal coupling or interference between the two slot antennas, to enhance the transmitting efficiency. Alternatively, the present invention partially connects two slot antennas, and uses a parasitic element to switch the current directions of adjacent portion between the two slot antennas, to reduce coupling effect; thus, signal coupling or interference between the two slot antennas can be reduced effectively as well and the transmitting efficiency can be enhanced.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna system for a wireless communication device, comprising:

a first metal slice, substantially conforming to a rectangular shape, formed with a first slot structure substantially extending along a horizontal direction;

a second metal slice, disposed on a side of the first metal slice along the horizontal direction, substantially conforming to a rectangular shape, formed with a second slot structure substantially extending along the horizontal direction, and partially connected to the first metal slice;

a first signal transmission line, comprising:

a first metal wire, electrically connecting to a first feeding terminal of the first metal slice, for transmitting signals, wherein the first feeding terminal is substantially disposed on a side of the first slot structure along a vertical direction;

a first isolation layer, covering the first metal wire; and a first metal weave, covering the first isolation layer and electrically connecting to a first signal grounding terminal to connect to a first signal ground, wherein the first signal grounding terminal is substantially disposed on another side of the first slot structure along the vertical direction; and a second signal transmission line, comprising:

a second metal wire, electrically connecting to a second feeding terminal of the second metal slice, for transmitting signals, wherein the second feeding terminal is substantially disposed on a side of the second slot structure along the vertical direction;

a second isolation layer, covering the second metal wire; and a second metal weave, covering the second isolation layer and electrically connecting to a second signal grounding terminal to connect to a second signal ground, wherein the second signal grounding terminal is substantially disposed on another side of the second slot structure along the vertical direction;

wherein an adjacent portion of the first metal slice and the second metal slice is further formed with a third slot structure;

wherein the third slot structure is a closed slot with a length substantially equal to a quarter of a wavelength of wireless signals corresponding to a wireless frequency band of the wireless communication device, or the third slot structure is an open slot with a length substantially equal to a half of a wavelength of wireless signals corresponding to a wireless frequency band of the wireless communication device.

2. The antenna system of claim 1, wherein a first direction from the first feeding terminal to the first signal grounding terminal is substantially the same with a second direction from the second feeding terminal to the second signal grounding terminal.

3. The antenna system of claim 1, wherein a first direction from the first feeding terminal to the first signal grounding terminal is substantially opposite to a second direction from the second feeding terminal to the second signal grounding terminal.

4. The antenna system of claim 1, wherein a connecting portion between the first metal slice and the second metal slice comprises a grounding element electrically connecting to a system ground of the wireless communication device.

5. The antenna system of claim 1, wherein a width of the third slot structure is related to isolation between the first metal slice and the second metal slice.

6. The antenna system of claim 1, wherein the third slot structure comprises at least one bend.

7. An antenna system for a wireless communication device, comprising:

a first metal slice, substantially conforming to a rectangular shape, formed with a first slot structure substantially extending along a horizontal direction;

a second metal slice, disposed on a side of the first metal slice along the horizontal direction, substantially conforming to a rectangular shape, formed with a second slot structure substantially extending along the horizontal direction;

a first signal transmission line, comprising:

a first metal wire, electrically connecting to a first feeding terminal of the first metal slice, for transmitting signals, wherein the first feeding terminal is substantially disposed on a side of the first slot structure along a vertical direction;

a first isolation layer, covering the first metal wire; and a first metal weave, covering the first isolation layer and electrically connecting to a first signal grounding terminal to connect to a first signal ground, wherein the first signal grounding terminal is substantially disposed on another side of the first slot structure along a vertical direction; and a second signal transmission line, comprising:

a second metal wire, electrically connecting to a second feeding terminal of the second metal slice, for transmitting signals, wherein the second feeding terminal is substantially disposed on a side of the second slot structure along a vertical direction;

a second isolation layer, covering the second metal wire; and a second metal weave, covering the second isolation layer and electrically connecting to a second signal grounding terminal to connect to a second signal ground, wherein the second signal grounding terminal is substantially disposed on another side of the second slot structure along a vertical direction;

wherein a first direction from the first feeding terminal to the first signal grounding terminal is substantially opposite to a second direction from the second feeding terminal to the second signal grounding terminal;

wherein the first metal slice and the second metal slice are partially connected, and an adjacent portion of the first metal slice and the second metal slice is further formed with a third slot structure;

wherein the third slot structure is a closed slot with a length substantially equal to a quarter of a wavelength of wireless signals corresponding to a wireless frequency band of the wireless communication device, or the third slot structure is an open slot with a length substantially equal to a half of a wavelength of wireless signals corresponding to a wireless frequency band of the wireless communication device.

8. The antenna system of claim 7, wherein the first metal slice and the second metal slice are separated by a distance, and the distance is related to isolation between the first metal slice and the second metal slice.

9. The antenna system of claim 8, wherein the first metal slice further comprises a first grounding element, the second metal slice further comprises a second grounding element, and the first grounding element is adjacent to the second grounding element.

10. The antenna system of claim 7, wherein the first metal slice and the second metal slice are partially connected, wherein a connecting portion between the first metal slice and the second metal slice comprises a grounding element electrically connecting to a system ground of the wireless communication device.

11. The antenna system of claim 7, wherein a width of the third slot structure is related to isolation between the first metal slice and the second metal slice.

12. The antenna system of claim 7, wherein the third slot structure comprises at least one bend.

* * * * *